US005344917A

United States Patent [19]

Furukawa et al.

[11] Patent Number: 5,344,917

[45] Date of Patent: Sep. 6, 1994

[54] PROCESS FOR PRODUCING REGENERATED COLLAGEN FIBER

[75] Inventors: Mitsuru Furukawa; Masahiko Takada; Shoichi Murata; Atsushi Sasayama, all of Hyogo, Japan

[73] Assignee: Kanegafuchi Kagaku Kogyo Kabushiki Kaisha, Osaka, Japan

[21] Appl. No.: 997,487

[22] Filed: Dec. 28, 1992

[30] Foreign Application Priority Data

Dec. 26, 1991 [JP] Japan ..... 3-344838

[51] Int. Cl.[5] ..... D01C 3/00; A61K 9/06; C08H 1/06; C09H 1/04

[52] U.S. Cl. ..... 530/356

[58] Field of Search ..... 530/356; 514/21, 801

[56] References Cited

U.S. PATENT DOCUMENTS 3,691,281 9/1972 Battista et al. ..... 530/356
4,268,131 5/1981 Miyata et al. ..... 351/160 R
4,713,446 12/1987 DeVore et al. ..... 530/356

FOREIGN PATENT DOCUMENTS 1444812 8/1976 United Kingdom .

OTHER PUBLICATIONS

Derwent Abstract of JP-A-3 027 110 (Mar. 5, 1991).
Derwent Abstract of JP-66-015 259 (1968).

*Primary Examiner*—Howard E. Schain
*Assistant Examiner*—P. Lynn Touzeau
*Attorney, Agent, or Firm*—Armstrong, Westerman, Hattori, McLeland & Naughton

[57] ABSTRACT

A process for producing regenerated collagen fiber from solubilized collagen including adjusting a degree of swelling of solubilized collagen to 100 to 300% and then treating the resulting solubilized collagen with an aqueous solution of a metallic salt. The regenerated collagen fiber has excellent water resistance and undergoes no waving on contact with water.

5 Claims, No Drawings

PROCESS FOR PRODUCING REGENERATED COLLAGEN FIBER

FIELD OF THE INVENTION

This invention relates to a process for producing regenerated collagen fiber. More particularly, it relates to a process for producing regenerated collagen fiber with excellent water resistance which undergoes substantially no waving of fiber on contact with water and is suitable as a substitute for human hair, animal hair, etc. or as a catgut.

BACKGROUND OF THE INVENTION

In order to improve wet properties, for example, water resistance of regenerated collagen fiber, it has been proposed to react the amino group or carboxyl group of collagen molecules with a methylol-containing compound as disclosed in JP-B-40-9062 (the term "JP-B" as used herein means an "examined published Japanese patent application") or to crosslink collagen molecules with formalin, a polyfunctional compound, or a basic chromate as disclosed JP-B-41-15259, JP-B-43-12633, and JP-B-47-14021. These proposals, as usually carried out in the leather industry, are effective on leather mainly comprising insoluble collagen, but not on regenerated collagen fiber comprising soluble collagen because the resulting fiber, when contacted with water, undergoes waving or shows high water absorption only to have insufficient water resistance, such as wet strength.

SUMMARY OF THE INVENTION

An object of the present invention is to provide a process for producing regenerated collagen fiber which has excellent water resistance and undergoes substantially no waving on contact with water.

As a result of extensive investigations, the inventors have now found that the above object of the present invention is accomplished by treating soluble collagen having metallic salt aqueous solution. The present invention has been completed based on this finding.

The present invention relates to a process for producing regenerated collagen fiber from solubilized collagen comprising adjusting a degree of swelling of solubilized collagen to 100 to 300% and then treating the resulting solubilized collagen with an aqueous solution of a metallic salt.

DETAILED DESCRIPTION OF THE PREFERRED EMBODIMENTS

The starting material which can be used in the present invention is a solution of solubilized collagen, i.e., a spinning dope, which can be prepared by solubilizing raw hide of animals, such as cattle or pigs, either fresh or salted, with an alkali or an enzyme and preparing an acidic aqueous solution.

If desired, the solubilized collagen solution may contain additives, such as stabilizers, modifiers, and water-soluble high polymers, for the purpose of improving mechanical strength, gloss or weather resistance of the resulting regenerated collagen fiber, imparting resistance to rotting and mildew resistance to the resulting regenerated collagen fiber, or improving spinnability of the spinning dope.

The solubilized collagen solution is spun through a spinneret into a coagulating bath comprising an aqueous solution of an inorganic salt, such as sodium sulfate, sodium chloride, anlmonium sulfate, magnesium chloride or aluminum sulfate, to obtain fibrous solubilized collagen.

If desired, the resulting fibrous solubilized collagen may be immersed in an aqueous solution of a water-soluble organic crosslinking agent (hereinafter described) in a concentration of, e.g., from 0.05 to 10% by weight for at least 0.3 second to insolubilize the protein.

In the present invention, the degree of swelling of the resulting fibrous solubilized collagen is adjusted to a range of from 100 to 300%. The terminology "degree of swelling" as used herein means a rate of weight increase on immersion in a metallic salt aqueous solution (hereinafter described).

Adjustment of the degree of swelling can be carried out by (a) a method comprising drying the fibrous solubilized collagen and treating it with a water-soluble organic crosslinking agent or (b) a method comprising treating the fibrous solubilized collagen with a water-soluble organic solvent followed by dehydration.

In method (a), drying of the fibrous solubilized collagen is preferably carried out in a uniform hot-air drier at 100° C. or lower for at least 15 minutes to reduce the water content to 30% by weight or less, and preferably 20% by weight or less. In order to prevent gluing among solubilized collagen fibers, it is recommended that the fibrous solubilized collagen is dried while it still contains the inorganic salt-containing coagulating solution or an oil having release properties is previously applied to the fibrous solubilized collagen prior to the drying.

The thus dried solubilized collagen is treated with a water-soluble organic crosslinking agent.

Specific but non-limiting examples of suitable water-soluble organic crosslinking agents include monoaldehydes, e.g., formaldehyde, acetaldehyde, methylglyoxal, and acrolein; dialdehydes, e.g., glyoxal, malondialdehyde, succindialdehyde, glutaraldehyde, phthalaldehyde, dialdehyde, and starch; epoxy compounds, e.g., glycol glycidyl ether or a polyol glycidyl ether, and a glycidyl ester of a monocarboxylic acid, dicarboxylic acid or polycarboxylic acid; N-methylol compounds, e.g., urea, melamine, acrylamide, methacrylamide, and N-methylol compounds derived from polymers of these compounds; water-soluble polyurethane obtained by introducing an isocyanate group into a polyol or a polycarboxylic acid and adding sodium hydrogensulfite; chlorotriazine derivatives, e.g., monochlorotriazine and dichlorotriazine; sulfuric ester of oxyethylsulfone or vinylsulfone derivatives, tannin, and synthetic tannin. These water-soluble organic crosslinking agents may be used either individually or in combination of two or more thereof. Among these agents, formaldehyde and glutaraldehyde are preferred because they are generally used in the leather industry and are therefore easily available.

The water-soluble organic crosslinking agent is generally used as an aqueous solution in a concentration usually of from 0.05 to 10% by weight, and preferably of from 0.3 to 5% by weight. If the concentration is less than 0.05% by weight, the crosslinking reaction is retarded only to need an extended treating time, resulting in a reduction of industrial productivity. Solutions having concentrations exceeding 10% by weight give arise to problems in industrial handling, environmental pollution, and workability. The solution is usually adjusted to a pH of 7 to 13 with, for example, boric acid, sodium acetate or sodium hydroxide. If the pH of the solution is less than 7, the crosslinking reaction is retarded only to need an extended treating time, resulting in a reduction of industrial productivity. If it exceeds 13, the peptide linkage of the solubilized collagen is susceptible to hydrolysis.

The water-soluble organic crosslinking agent is preferably used in combination with an inorganic salt so as to prevent the collagen fiber from dissolving in the solution. Such inorganic salts include water-soluble salts, such as sodium sulfate, sodium chloride, ammonium sulfate, and aluminum sulfate. While not limiting, the water-soluble salt is usually added in a concentration of from 10% by weight up to saturation.

The temperature of the solution is not particularly limited but is preferably 40° C. or less, and particularly from 15° to 30° C. At temperatures above 40° C., there is a tendency that the solubilized collagen undergoes denaturation or shrinkage. The lower limit of the solution temperature is not critical and is appropriately decided according to the solubility of the inorganic salt added.

According to method (b), the solubilized collagen is treated with a water-soluble organic solvent.

Specific examples of suitable water-soluble organic solvents are acetone, methanol, ethanol, propanol, and butanol. These solvents may be used either individually or in combination of two or more thereof. The water-soluble organic solvent may contain up to 20% by weight of water.

The treatment with the organic solvent may be carried out by, for example, immersing the solubilized collagen in an aqueous solution of the solvent for a period usually of at least 5 minutes, and preferably 10 minutes or more, at a temperature usually of not more than 40° C., and preferably of from 15° to 30° C. If the treating time is too short, the degree of swelling of the resulting solubilized collagen in a metallic salt aqueous solution would exceed 300%. If the treating temperature is too high, there is a tendency that the solubilized collagen undergoes denaturation or shrinkage.

If the degree of swelling of the solubilized collagen is out of the range of from 100 to 300%, the finally obtained regenerated collagen fiber undergoes waving. Such waving seems to be ascribed to non-uniform crosslinking reaction as follows. If the degree of swelling exceeds 300%, the intermolecular distance of the solubilized collagen becomes too long for smooth induction of crosslinking reaction. As a result, non-uniform crosslinking would take place, resulting in an increased proportion of molecules with the one of the end groups thereof remaining free. If the degree of swelling is less than 100%, the intermolecular distance of the solubilized collagen becomes too narrow to allow smooth penetration of the metallic salt aqueous solution therethrough, thus resulting in non-uniform crosslinking reaction.

The solubilized collagen fiber thus treated by methods (a) or (b) is then dried, for example, in a uniform hot-air drier at 100° C. or lower for 15 minutes or more or adjusted to pH 3 or less with sulfuric acid, hydrochloric acid, acetic acid, lactic acid, etc. so as to facilitate penetration of a metallic ion into the collagen fiber while inhibiting olation. The olation is to produce large molecule weight colloidal compound which is formed by coagulation of the metallic atoms through —OH group.

Then, the solubilized collagen fiber is subjected to a treatment with a metallic salt aqueous solution.

Specific examples of suitable metallic salts are chromium sulfate, aluminum sulfate, aluminum chloride, zirconium sulfate, stannous chloride, and stannic chloride. These metallic salts may be used either individually or in combination of two or more thereof.

The metallic salt aqueous solution preferably has a concentration of from 0.05 to 10% by weight, and particularly from 0.2 to 5% by weight, reduced to a metal oxide. If the concentration is lower than 0.05% by weight, crosslinking is insufficient to cause non-uniformity, resulting in a tendency to waving. Even if the concentration exceeds 10% by weight, no further improving effects can be expected, rather resulting in economical disadvantage. The metallic salt aqueous solution preferably has a pH of from 2 to 4, and more preferably from 2.5 to 3.5. If the pH is too high, a precipitate of the metallic salt would increase, and the action on collagen is reduced. If it is too low, there is a tendency that the solubilized collagen is denatured and the organic crosslinking agent is released.

The treatment with the metallic salt aqueous solution can be carried out usually at a liquid temperature of not more than 60° C., and preferably from 15° to 40° C., for a period of not less than 8 hours, and preferably from about 10 to 14 hours. At higher liquid temperatures, the solubilized collagen fiber tends to undergo denaturation or shrinkage. If the treating time is shorter than 8 hours, crosslinking would be insufficient to cause non-uniformity, resulting in a tendency to waving.

After completion of the treatment with the metallic salt aqueous solution, an alkali, such as sodium hydroxide, potassium hydroxide, sodium carbonate, potassium carbonate, sodium hydrogencarbonate, potassium hydrogencarbonate, sodium phosphate, potassium phosphate, sodium silicate or sodium borate, is added to the metallic salt aqueous solution to adjust to a pH of 4 to 5, and the solution is kept at 40° to 50° C. for 3 to 8 hours to thereby accelerate olation to convert the metallic salt to an insoluble metallic compound and to fix the metallic compound inside the fiber.

The thus treated collagen fiber is thoroughly washed with water and, if desired, subjected to a treatment with an oil or an organic crosslinking agent, followed by drying.

The resulting regenerated collagen fiber undergoes substantially no waving even if water adheres thereto during processing of the fiber or during use of the final product probably because swelling of the regenerated collagen fiber with water takes place uniformly.

The present invention is now illustrated in greater detail with reference to Examples, but it should be understood that the present invention is not construed as being limited thereto. All the percents are by weight unless otherwise indicated.

EXAMPLE 1

A 6% acidic aqueous solution of alkali-solubilized collagen was spun through a spinneret having 50 pores of 0.35 mm in diameter at a spinning speed of 4 m/min into a coagulation bath containing 20% sodium sulfate and 1% formaldehyde having been adjusted to a pH of 11 with boric acid and sodium hydroxide and set at 25° C. The spun filaments were washed in a series of two water tanks, taken up at a speed of 4.2 m/min, and further washed with running water. The resulting fiber was dipped in a bath containing a lubricant oil comprising an amino-modified silicone emulsion and a Pluronic type polyether antistatic agent which is well known in the art, as α-hydro-ω-hydroxypoly(oxyethylene)-poly(oxypropylene)-poly(oxyethylene) block copolymer, and then dried under tension in a uniform hot-air drier at 80° C.

The fiber was treated in a treating bath containing 15% sodium sulfate and 1% formaldehyde having been adjusted to a pH of 9 with boric acid and sodium hydroxide at 25° C. for 15 hours, washed with water, and dried under tension. The fiber was then immersed in a metallic salt aqueous solution containing 3% of sodium sulfate and 1%, reduced to $Cr_2O_3$, of basic chromium sulfate ("Neochrome" produced by Nippon Chemical Industrial Co., Ltd.) and having a pH of 3 at 25° C. for 16 hours. The solution containing the fiber was adjusted to a pH of 4.5 by addition of sodium carbonate and kept at 40° to 45° C. for 5 hours (degree of swelling: 150%). After washing with water, the fiber was dried under tension in a uniform hot-air drier at 80° C.

When the resulting regenerated collagen fiber was brought into contact with water at room temperature, there was observed no waving.

The degree of swelling of the fiber in the aqueous solution of the water-soluble crosslinking agent (basic chromium sulfate) was measured according to the following method.

Measurement of Degree of Swelling

The fiber taken out from the basic chromium sulfate aqueous solution was put between sheets of filter paper and pressed down with a hand to completely remove the liquid adhered to the surface, and the weight ($W_1$) was measured. The fiber was thoroughly washed with water and dried at 80° C. for 3 hours or more and then cooled in a desiccator for 1 hour or more, and the weight ($W_0$) was measured. The degree of swelling of the fiber in the chromate crosslinking solution was calculated according to equation:

$$\text{Degree of Swelling } (\%) = [(W_1 - W_0)/W_0] \times 100$$

The resulting regenerated collagen fiber was evaluated in terms of water absorption, wet strength ratio, and occurrence of waving according to the following test methods. The results obtained are shown in Table 1 below.

Water Absorption

The regenerated collagen fiber was soaked in warm water at 50° C. for 1 hour to allow water to be sufficiently absorbed. The weight ($W_a$) of the fiber after wiping adhered water from the surface and the constant weight ($W_b$) of the fiber after drying in a uniform heat oven at 105° C. were measured to obtain a percent water absorption according to equation:

$$\text{Water Absorption } (\%) = [(W_a - W_b)/W_a] \times 100$$

Wet Strength Ratio

A normal strength of a monofilament of the regenerated collagen was measured under normal conditions (20±2° C., 65±2% RH) with a universal tensile testing machine ("Tensilon UTM-L" manufactured by Toyo Baldwin Co., Ltd.).

A monofilament of the regenerated collagen was sufficiently soaked in water under normal conditions, and the wet strength was measured with a universal tensile testing machine "Tensilon UTM-L".

A wet strength ratio was obtained from equation:

$$\text{Wet Strength Ratio} = \text{Wet Strength}/\text{Normal Strength}$$

Occurrence of Waving

Water at 30° C. or lower was supplied to a weft having a length of 30 cm under normal conditions (20±2° C.; 65±2% RH) using a spray. After combing, the state of the fiber was observed with the naked eye for 10 minutes.

EXAMPLE 2

A 6% acidic aqueous solution of alkali-solubilized collagen was spun through a spinneret having 50 pores of 0.35 mm in diameter at a spinning speed of 4 m/min into a coagulation bath containing 20% sodium sulfate and 1% formaldehyde having been adjusted to a pH of 11 with boric acid and sodium hydroxide and set at 25° C. The spun filaments were washed in a series of two water tanks, taken up at a speed of 4.2 m/min, and further washed with running water. The resulting fiber was dipped in a bath containing a lubricant oil comprising an amino-modified silicone emulsion and a Pluronic type polyether antistatic agent and then dried under tension in a uniform hot-air drier at 80° C.

The fiber was treated in a treating bath containing 15% sodium sulfate and 1% formaldehyde having been adjusted to a pH of 9 with boric acid and sodium hydroxide at 25° C. for 15 hours, washed with water, and immersed in water at pH 3 for 2 hours.

The fiber was then immersed in a metallic salt aqueous solution containing 3% of sodium sulfate and 1%, reduced to $Cr_2O_3$, of basic chromium sulfate "Neochrome" and having a pH of 3 at 25° C. for 16 hours. The solution was adjusted to a pH of 4.5 with sodium carbonate and kept at 40° to 45° C. for 5 hours (degree of swelling: 150%). The fiber was washing with water and dried under tension in a uniform hot-air drier at 80° C.

When water was supplied to the resulting regenerated collagen fiber at room temperature, there was observed no waving.

The physical properties of the resulting regenerated collagen fiber were measured in the same manner as in Example 1. The results obtained are shown in Table 1.

EXAMPLE 3

A 6% acidic aqueous solution of alkali-solubilized collagen was spun through a spinneret having 50 pores of 0.35 mm in diameter at a spinning speed of 4 m/min into a coagulation bath containing 20% sodium sulfate and 1% formaldehyde having been adjusted to a pH of 11 with boric acid and sodium hydroxide and set at 25° C. The spun filaments were washed in a series of two water tanks, taken up at a speed of 4.2 m/min, and further washed with running water. The resulting fiber was dipped in a bath containing a lubricant oil comprising an amino-modified silicone emulsion and a Pluronic type polyether antistatic agent and then dried under tension in a uniform hot-air drier at 80° C.

The fiber was treated in a treating bath containing 15% sodium sulfate and 1% glutaraldehyde having been adjusted to a pH of 9 with boric acid and sodium hydroxide at 25° C. for 15 hours, washed with water, and dried under tension.

The fiber was then immersed in a metallic salt aqueous solution containing 3% of sodium sulfate and 1%, reduced to $Cr_2O_3$, of basic chromium sulfate "Neochrome" and having a pH of 3 at 25° C. for 16 hours. The solution was adjusted to a pH of 4.5 with sodium carbonate and kept at 40° to 45° C. for 5 hours (degree of swelling: 150%). After washing with water, the fiber was dried under tension in a uniform hot-air drier at 80° C.

When water was supplied to the resulting regenerated collagen fiber at room temperature, there was observed no waving.

The physical properties of the resulting regenerated collagen fiber were measured in the same manner as in Example 1. The results obtained are shown in Table 1.

EXAMPLE 4

A 6% acidic aqueous solution of alkali-solubilized collagen was spun through a spinneret having 50 pores of 0.35 mm in diameter at a spinning speed of 4 m/min into a coagulation bath containing 20% sodium sulfate and 1% formaldehyde having been adjusted to a pH of 11 with boric acid and sodium hydroxide and set at 25° C. The spun filaments were washed in a series of two water tanks, taken up at a speed of 4.2 m/min, and further washed with running water. The resulting fiber was dipped in a bath containing a lubricant oil comprising an amino-modified silicone emulsion and a Pluronic type polyether antistatic agent and then dried under tension in a uniform hot-air drier at 80° C.

The fiber was treated in a treating bath containing 15% sodium sulfate and 1% glutaraldehyde having been adjusted to a pH of 9 with boric acid and sodium hydroxide at 25° C. for 15 hours, washed with water, and immersed in water at pH 3 for 2 hours.

The fiber was then immersed in a metallic salt aqueous solution containing 3% of sodium sulfate and 1%, reduced to $Cr_2O_3$, of basic chromium sulfate "Neochrome" and having a pH of 3 at 25° C. for 16 hours. The solution was adjusted to a pH of 4.5 with sodium carbonate and kept at 40° to 45° C. for 5 hours (degree of swelling: 150%). After washing with water, the fiber was dried under tension in a uniform hot-air drier at 80° C.

When water was supplied to the resulting regenerated collagen fiber at room temperature, there was observed no waving.

The physical properties of the resulting regenerated collagen fiber were measured in the same manner as in Example 1. The results obtained are shown in Table 1.

EXAMPLE 5

Regenerated collagen fiber was obtained in the same manner as in Example 4, except for using a coagulation bath containing 20% sodium sulfate and having been adjusted to a pH of 11 with boric acid and sodium hydroxide and set at 25° C. and a treating bath containing 15% sodium sulfate and 1% formaldehyde and having been adjusted to a pH of 9 with boric acid and sodium hydroxide.

When water was supplied to the resulting regenerated collagen fiber at room temperature, there was observed no waving.

The physical properties of the resulting regenerated collagen fiber were measured in the same manner as in Example 1. The results obtained are shown in Table 1.

EXAMPLE 6

Regenerated collagen fiber was obtained in the same manner as in Example 5, except that the final treatment at pH 4.5 and at 40° to 45° C. was not carried out.

When water was supplied to the resulting regenerated collagen fiber at room temperature, there was observed no waving.

The physical properties of the resulting regenerated collagen fiber were measured in the same manner as in Example 1. The results obtained are shown in Table 1.

EXAMPLE 7

A 6% acidic aqueous solution of alkali-solubilized collagen was spun through a spinneret having 50 pores of 0.35 nun in diameter at a spinning speed cf 4 m/min into a coagulation bath containing 20% sodium sulfate and 1% formaldehyde having been adjusted to a pH of 11 with boric acid and sodium hydroxide and set at 25° C. The spun filaments were washed in a series of two water tanks, taken up at a speed of 4.2 m/min, and further washed with running water.

The resulting fiber was dipped in a 80% acetone aqueous solution for 10 minutes and then allowed to stand for 10 minutes.

The fiber was then immersed in a metallic salt aqueous solution containing 3% of sodium sulfate and 1%, reduced to $Cr_2O_3$, of basic chromium sulfate "Neochrome" and having a pH of 3 at 25° C. for 16 hours. The solution was adjusted to a pH of 4.5 with sodium carbonate and kept at 40° to 45° C. for 5 hours (degree of swelling: 270%). After washing with water, the fiber was dipped in a bath containing a lubricant oil comprising an amino-modified silicone emulsion and a Pluronic type polyether antistatic agent and then dried under tension in a uniform hot-air drier at 80° C. to obtain regenerated collagen fiber.

When water was supplied to the resulting regenerated collagen fiber at room temperature, there was observed no waving.

The physical properties of the resulting regenerated collagen fiber were measured in the same manner as in Example 1. The results obtained are shown in Table 1.

COMPARATIVE EXAMPLE 1

A 6% acidic aqueous solution of alkali-solubilized collagen was spun through a spinneret having 50 pores of 0.35 mm in diameter at a spinning speed of 4 m/min into a coagulation bath containing 20% sodium sulfate having been adjusted to a pH of 3.6 with acetic and sodium acetate and set at 25° C. The spun filaments were dried under tension in a uniform hot-air drier at 60° C.

The fiber was then immersed in a metallic salt aqueous solution containing 3% of sodium sulfate and 1%, reduced to $Cr_2O_3$, of basic chromium sulfate "Neochrome" and having a pH of 3 at 25° C. for 16 hours. The solution was adjusted to a pH of 4.5 with sodium carbonate and kept at 40° to 45° C. for 5 hours (degree of swelling: 500%). After washing with water, the fiber was dried under tension in a uniform hot-air drier at 80° C. to obtain regenerated collagen fiber.

When water was supplied to the resulting regenerated collagen fiber at room temperature, there was observed waving.

The physical properties of the resulting regenerated collagen fiber were measured in the same manner as in Example 1. The results obtained are shown in Table 1.

COMPARATIVE EXAMPLE 2

A 6% acidic aqueous solution of alkali-solubilized collagen was spun through a spinneret having 50 pores of 0.35 mm in diameter at a spinning speed of 4 m/min into a coagulation bath containing 20% sodium sulfate and 1% formaldehyde having been adjusted to a pH of 11 with boric and sodium hydroxide and set at 25° C. The spun filaments were washed in a series of two water tanks, taken up at a speed of 4.2 m/min, and further washed with running water.

The fiber was treated in a treating bath containing 15% sodium sulfate and 1% formaldehyde and having been adjusted to a pH of 9 with boric acid and sodium hydroxide at 25° C. for 15 hours. After washing with water, the fiber was immersed in a 3% sodium sulfate aqueous solution at pH 3 for 2 hours.

The fiber was then immersed in a metallic salt aqueous solution containing 3% of sodium sulfate and 1%, reduced to $C_2O_3$, of basic chromium sulfate "Neochrome" and having a pH of 3 at 25° C. for 16 hours. The solution was adjusted to a pH of 4.5 with sodium carbonate and kept at 40° to 45° C. for 5 hours (degree of swelling: 400%). After washing with water, the fiber was dried under tension in a uniform hot-air drier at 80° C. to obtain regenerated collagen fiber.

When water was supplied to the resulting regenerated collagen fiber at room temperature, there was observed waving.

The physical properties of the resulting regenerated collagen fiber were measured in the same manner as in Example 1. The results obtained are shown in Table 1.

COMPARATIVE EXAMPLE 3

A 6% acidic aqueous solution of alkali-solubilized collagen was spun through a spinneret having 50 pores of 0.35 mm in diameter at a spinning speed of 4 m/min into a coagulation bath containing 20% sodium sulfate and 1% formaldehyde having been adjusted to a pH of 11 with boric and sodium hydroxide and set at 25° C. The spun filaments were washed in a series of two water tanks, taken up at a speed of 4.2 m/min, and further washed with running water.

The fiber was immersed in a water tank having been adjusted to a pH of 3 with sulfuric acid for 2 hours and then immersed in a metallic salt aqueous solution containing 3% of sodium sulfate and 1%, reduced to $Cr_2O_3$, of basic chromium sulfate "Neochrome" and having a pH of 3 at 25° C. for 16 hours. The solution was adjusted to a pH of 4.5 with sodium carbonate and kept at 40 to 45° C. for 5 hours (degree of swelling: 400%). After washing with water, the fiber was dried under tension in a uniform hot-air drier at 80° C. to obtain regenerated collagen fiber.

When water was supplied to the resulting regenerated collagen fiber at room temperature, there was observed waving.

The physical properties of the resulting regenerated collagen fiber were measured in the same manner as in Example 1. The results obtained are shown in Table 1.

COMPARATIVE EXAMPLE 4

A 6% acidic aqueous solution of alkali-solubilized collagen was spun through a spinneret having 50 pores of 0.35 mm in diameter at a spinning speed of 4 m/min into a coagulation bath containing 20% sodium sulfate and 1% formaldehyde having been adjusted to a pH of 11 with boric and sodium hydroxide and set at 25° C. The spun filaments were washed in a series of two water tanks, taken up at a speed of 4.2 m/min, and further washed with running water.

The fiber was dipped in a bath containing a lubricant oil comprising an amino-modified silicone emulsion and a Pluronic type polyether antistatic agent and then dried under tension in a uniform hot-air drier at 80° C.

The fiber was then immersed in a metallic salt aqueous solution containing 20% of sodium sulfate and 1%, reduced to $Cr_2O_3$, of basic chromium sulfate "Neochrome" and having a pH of 3 at 25° C. for 16 hours. The solution was adjusted to a pH of 4.5 with sodium carbonate and kept at 40° to 45° C. for 5 hours (degree of swelling: 90%). After washing with water, the fiber was dried under tension in a uniform hot-air drier at 80° C. to obtain regenerated collagen fiber.

When water was supplied to the resulting regenerated collagen fiber at room temperature, there was observed waving.

The physical properties of the resulting regenerated collagen fiber were measured in the same manner as in Example 1. The results obtained are shown in Table 1.

COMPARATIVE EXAMPLE 5

A 6% acidic aqueous solution of alkali-solubilized collagen was spun through a spinneret having 50 pores of 0.35 mm in diameter at a spinning speed of 4 m/min into a coagulation bath containing 20% sodium sulfate and 1% formaldehyde having been adjusted to a pH of 11 with boric and sodium hydroxide and set at 25° C. The spun filaments were washed in a series of two water tanks, taken up at a speed of 4.2 m/min, and further washed with running water.

The fiber was dipped in a bath containing a lubricant oil comprising an amino-modified silicone emulsion and a Pluronic type polyether antistatic agent and then dried under tension in a uniform hot-air drier at 80° C.

The fiber was then immersed in a metallic salt aqueous solution containing 1%, reduced to $Cr_2O_3$, of basic chromium sulfate "Neochrome" and having a pH of 3 at 25° C. for 16 hours. The solution was adjusted to a pH of 4.5 with sodium carbonate and kept at 40 to 45° C. for 5 hours (degree of swelling: 320%). After washing with water, the fiber was dried under tension in a uniform hot-air drier at 80° C. to obtain regenerated collagen fiber.

When water was supplied to the resulting regenerated collagen fiber at room temperature, there was observed waving.

The physical properties of the resulting regenerated collagen fiber were measured in the same manner as in Example 1. The results obtained are shown in Table 1.

TABLE 1

| Example No. | Degree of Swelling (%) | Water Absorption (%) | Wet Strength Ratio | Waving |
|---|---|---|---|---|
| Example 1 | 150 | 60 | 0.64 | not observed |
| Example 2 | 150 | 60 | 0.65 | not observed |
| Example 3 | 150 | 60 | 0.66 | not observed |
| Example 4 | 150 | 60 | 0.66 | not observed |
| Example 5 | 200 | 65 | 0.65 | not observed |
| Example 6 | 250 | 70 | 0.66 | not observed |

TABLE 1-continued

| Example No. | Degree of Swelling (%) | Water Absorption (%) | Wet Strength Ratio | Waving |
|---|---|---|---|---|
| Example 7 | 270 | 70 | 0.63 | not observed |
| Compara. Example 1 | 500 | 120 | 0.40 | observed |
| Compara. Example 2 | 400 | 90 | 0.57 | observed |
| Compara. Example 3 | 400 | 100 | 0.57 | observed |
| Compara. Example 4 | 90 | 100 | 0.55 | observed |
| Compara. Example 5 | 320 | 90 | 0.50 | observed |

According to the process of the present invention, there is obtained regenerated collagen fiber which has improved water resistance and is prevented from waving on contact with water during fiber processing or on use of the final fiber product. For example, waving of the fiber does not occur where the fiber used as artificial hair of a wig is damped for curling. Therefore, such water-resistant regenerated collagen fiber are suitable as artificial human or animal hair or a catgut.

While the invention has been described in detail and with reference to specific examples thereof, it will be apparent to one skilled in the art that various changes and modifications can be made therein without departing from the spirit and scope thereof.

What is claimed is:

1. A process for producing regenerated collagen fiber from solubilized collagen comprising adjusting a degree of swelling of solubilized collagen to 100 to 300% and then crosslinking the resulting solubilized collagen with an aqueous solution of a metallic salt.

2. A process as claimed in claim 1, wherein said degree of swelling is adjusted by first drying solubilized collagen to produce a dried collagen having a maximum water content of 30% and then treating said dried collagen with a water-soluble organic crosslinking agent.

3. A process as claimed in claim 2, wherein said water-soluble organic crosslinking agent is used as a 0.05 to 10% by weight aqueous solution at a pH of from 7 to 13.

4. A process as claimed in claim 2, wherein said water-soluble organic crosslinking agent is used in combination with an inorganic salt.

5. A process as claimed in claim 1, wherein said degree of swelling is adjusted by treating said solubilized collagen with a water-soluble organic solvent.

* * * * *